US005224593A

United States Patent [19]

Bennett

[11] Patent Number: 5,224,593

[45] Date of Patent: Jul. 6, 1993

[54] LENS SHIPPER/LENS CASE

[75] Inventor: Ron A. Bennett, El Toro, Calif.

[73] Assignee: Allergan, Inc., Irvine, Calif.

[21] Appl. No.: 819,875

[22] Filed: Jan. 13, 1992

[51] Int. Cl.[5] ..... A45G 11/04; B65D 81/22; B65D 85/38

[52] U.S. Cl. ..... 206/5.1; 53/425; 53/428; 53/449; 206/210; 422/300

[58] Field of Search ..... 206/5, 5.1, 210; 53/425, 428, 449; 422/300-303, 310

[56] References Cited

U.S. PATENT DOCUMENTS

| | | | |
|---|---|---|---|
| 3,101,087 | 8/1963 | Watson | 206/5.1 |
| 3,279,482 | 10/1966 | Hungerford et al. | 206/5.1 |
| 3,314,533 | 4/1987 | Kopfle | 206/5.1 |
| 3,344,461 | 10/1967 | Floor | 206/5.1 |
| 3,378,020 | 4/1968 | Grabiel | 206/5.1 |
| 3,379,200 | 4/1968 | Pennell | 206/5.1 |
| 3,462,301 | 8/1969 | Gershen | 206/5.1 |
| 3,536,082 | 10/1970 | Kolbeck | 206/5.1 |
| 4,011,941 | 3/1977 | Parsons | 206/5.1 |
| 4,838,413 | 6/1989 | Monestere | 206/5.1 |
| 5,131,532 | 7/1992 | Ives | 206/5.1 |

FOREIGN PATENT DOCUMENTS

| | | | |
|---|---|---|---|
| 0062951 | 5/1975 | Australia | 206/5.1 |
| 0413164 | 2/1991 | European Pat. Off. | 206/5.1 |

*Primary Examiner*—Jimmy G. Foster
*Attorney, Agent, or Firm*—Walter A. Hackler

[57] ABSTRACT

A combined shipping container and reusable lens case and system are provided for the storage, shipment, and consumer use of hydrophilic contact lenses. A plurality of bottomless bases, each including a cavity therein for containing a contact lens, is provided with each base including a universal coupling for enabling each base to be interconnected with another to provide a reusable lens case for a pair of contact lenses. Each base includes threads for engaging a lid in a manner for providing tamper indication upon first removal of each lid from each base. Indicia of lens configuration, or prescription, are imprinted or attached to a side of a bottom for the case in order to provide a permanent record of the lens configuration. The bottomless base and bottoms may be formed from material which enables the heat sealing of the bottom to the bottomless base. In addition, the material of construction is preferrable on which enables the autoclaving to sterility of the lens case. Accordingly, a method includes the assembly of a bottomless base and lid with subsequent filling with saline solution and a contact lens. When a bottom is heat sealed to the case, a combined shipping container and reusable lens case is formed.

11 Claims, 1 Drawing Sheet

LENS SHIPPER/LENS CASE

The present invention is generally related to containers for soft contact lens shipment from manufacturers and is particularly directed to a container suitable for the lens wearer as a reusable lens case.

A great number of soft contact lenses are produced from hydrophilic polymeric materials, for example, copolymers of hydroxyethyl methacrylate. As such, these lenses often comprise up to 90% of water and must be stored in an aqueous solution to prevent dehydration thereof.

Heretofore, manufacturers have shipped such contact lenses in vials, i.e., glass bottles, sealed with a stopper and a metal foil. Alternatively, plastic containers have been used which are designed for single use.

Such vials are not intended and indeed are not practical for reuse. In fact, once the metal safety seal has been removed, the stopper may not adequately seal the vial since it is subject to be dislodged upon rough handling thereof. Most practitioners utilize a special tool to provide a replacement metal foil seal in the event that a contact lens is to be re-stored in the vial.

While the packaging of contact lenses in vials has been commonplace, it is expensive from the standpoint of bottle cost and a heavy shipping weight per contact lens.

In addition, since the vial label contains the specification of the contact lens stored within the vial, once the contact lens is removed, there is no practical way for the user to keep track of his or her prescription.

The hereinabove recited disadvantages are overcome by the reusable lens case of the present invention which provides for convenient manufacture, packaging, shipping and subsequent convenient reuse by a user of the contact lens. In this regard, it provides an inexpensive packaging and shipment system for the manufacturer which, as an added feature, enables convenient removal of the contact lens and storage thereof by the consumer.

SUMMARY OF THE INVENTION

A combined shipping container and reusable lens case, in accordance with the present invention, for hydrophilic contact lenses generally includes a pair of bottomless bases, each having a means defining a cavity therein for containing a contact lens. Each base includes means for releasably attaching each base to one another to provide a reusable lens case for a pair of contact lenses.

This feature of the present invention enables any combination of packaged contact lenses to be combined, per the prescription of the consumer, utilizing the same bases in which the lenses are shipped from the manufacturer. Each of the bases has a means for sealably accepting a lid and a lid is provided for removably sealing each base cavity. In addition, a pair of bottoms are sized for fitting to each base.

A combined shipping container and reusable lens case system, in accordance with the present invention, includes a plurality of bottomless bases, each having means defining a cavity therein for containing a contact lens. Each of the bases includes means for releasably attaching each base to another base in order to provide a reusable lens case for a pair of contact lenses. In addition, each base has means for sealably accepting a lid and a plurality of bottoms are provided for sealing to each base.

More particularly, the bottomless base and the bottoms may be formed from material enabling heat sealing of the bottoms to the bottomless bases, and importantly, each bottom may include indicia as to the lens configuration on a side thereof facing a base cavity when the bottom is sealed to the base thereof. In this manner, proper lens identification is maintained. In addition, the base and bottom are preferrably formed from a material enabling autoclaving of the lens case to provide sterility.

Accordingly, a packaging method utilizing the system of the present invention includes the steps of disposing a saline solution in the bottomless base having a removable lid thereon and thereafter disposing a contact lens into the saline solution. Thereafter, the bottomless base is permanently sealed by, for example, heat sealing.

More specifically, the packaging method, according to the present invention, may include the step of attaching one base to another to form a consumer lens case for a pair of contact lenses.

BRIEF DESCRIPTION OF THE DRAWINGS

The advantages and features of the present invention will be better understood by the following description when considered in conjunction with the accompanying drawings in which.

DETAILED DESCRIPTION

Figure 1:
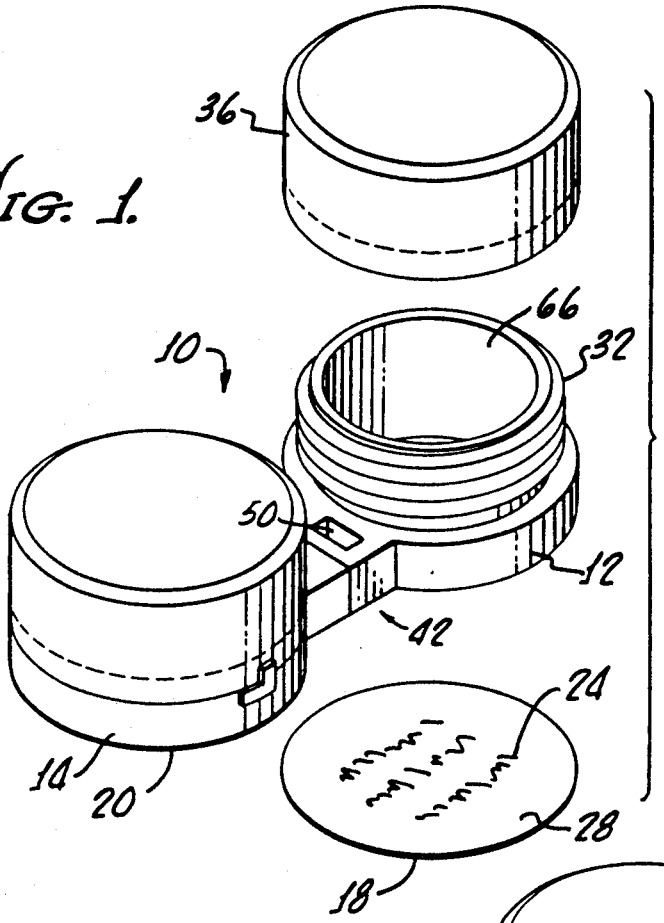
FIG. 1 is a partially exploded perspective view of two bases in accordance with the present invention joined in order to form a reusable case for a pair of contact lenses.
Figure 2:
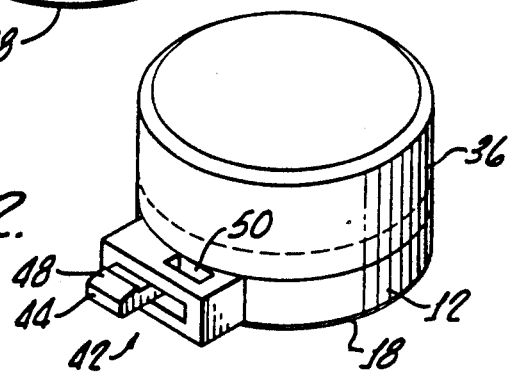
FIG. 2 is a perspective view of a single base having the cap removed and showing means for attaching the base to another base.

Turning now to FIGS. 1 and 2, there is shown a combined container and reusable lens case system 10 which generally includes a plurality of bases 12, 14 with FIG. 1 showing two bases 12, 14 being joined to form a reusable lens case.

The bases 12, 14, as well as bottoms 18, 20, may be formed of any suitable heat moldable plastic which enables the bottoms 18, 20 to be heat sealed to the bases 12, 14 as hereinafter described in connection with the method of the present invention. It should be appreciated that while a preferred embodiment of the present invention utilizes material suitable for heat sealing, any other suitable sealing or material joining process may be used to join the bottoms 18,20 to the bases 12, 14.

Any number of thermoplastic resins may be utilized and, where suitable, any amorphous or crystalline class of thermoplastic may be utilized. Common plastics which may be suitable are high and low density polyethylenes, polypropylenes, acetal resins, nylons, and thermoplastic polyesters. Also useful may be acrylonitrile-butadiene-styrene terpolymers, cellulose acetate, phenylene-oxide based resins, polycarbonates, poly(methylmacrolate), polystyrene, poly(vinyl chloride) and styrene-acrylonitrile copolymers.

Importantly, indicia 4 of the contact lens configuration, or prescription, which is to be stored in the base 12 may be printed or otherwise affixed to an inside of face 28 of the bottom 18 so that after sealing of the bottom 18 to the base 12, a permanent record of the lens prescription to be stored in the base 12 is kept.

The base 12 may be configured with threads 32 engaging the lid 36 for enabling a sealing relationship therebetween to prevent the saline solution (not shown) from leaking out of the lens case 10 after the lid 36 is screwed onto the base 12. A breakaway ring 40 of plastic, which may be formed or disposed onto the lid 36 or base 12, may be utilized in the conventional manner for providing tamper indication upon first removal of the lid 36 from the base 12.

As more clearly shown in FIG. 2, each base 12 includes puzzle lock coupling 42 which provides means for attaching each base to one other base 14 in order to provide a reusable lens case 10 for a pair of contact lenses (not shown).

Each coupling 42 may include a tongue 44 and corresponding receptical 46 suited for attaching any two bases 12, 14 to one another. If desired, a hook 48 may be disposed on each tongue 44 which may be manually depressed through a corresponding opening 50 to enable the bases 12, 14 to be separated after coupling.

Figure 3A:
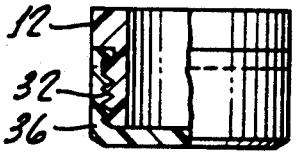
FIGS. 3*a*, 3*b*, and 3*c* depict a packaging method in accordance with the present invention.
Figure 3B:
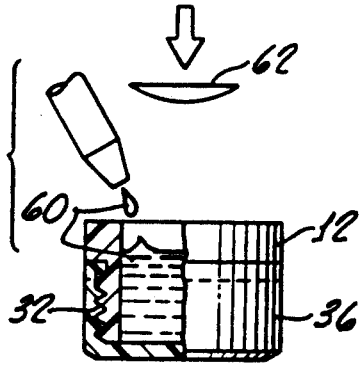
Figure 3C:
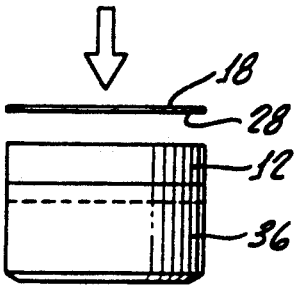

A packaging method suitable for contact lens shipping and subsequent consumer use is illustrated in FIGS. 3*a*, 3*b* and 3*c*. The base 12 and lid 36 may be assembled and inverted to enable a saline solution 60 to be disposed therein preceding the placement of the contact lens 62 into the base 12 with the saline solution 60.

Thereafter, the bottom 18 is heat sealed to the base 12, as indicated in FIG. 3*c*. Preferably, the indicia 24 on the side 28 is positioned for facing the base cavity 66. Alternatively, the prescription indicia 24 may be facing outwardly from the face 12, or the indicia 24 may be imprinted or embossed on both inside 28 and outside 70 surface of the bottom 18.

Thereafter, the bottoms 12 and 14 may be attached as shown in FIG. 1 to form a consumer lens case 10 for a pair of contact lenses 62.

Although there has been hereinabove described a container for plastic lens shipment in accordance with the present invention, for the purpose of illustrating the manner in which the invention may be used to advantage, it should be appreciated that the invention is not limited thereto. Accordingly, any and all modifications, variations, or equivalent arrangements which may occur to those skilled in the art, should be considered to be within the scope of the present invention as defined in the appended claims.

What is claimed is:

1. A combined shipping container and reusable lens case for hydrophilic contact lenses comprising:

a pair of bottomless bases each having means defining a cavity therein for containing a contact lens, each base including means for releasably attaching each base to one another to provide a reusable lens case for a pair of contact lenses, each base having means for sealably accepting a lid;

a pair of bottoms sized for fitting to each base; and lid means for removably sealing each base cavity.

2. The combined shipping container and reusable lens case according to claim 1 wherein said bottomless bases and bottoms are formed from a material enabling the heat sealing of said bottoms to said bottomless bases.

3. The combined shipping container and reusable lens case according to claim 2 wherein each bottom includes an indicia of lens configuration on a side thereof facing a base cavity.

4. A combined shipping container and reusable lens case system for hydrophilic contact lenses comprising:

a plurality of bottomless bases, each having means defining a cavity therein for containing a contact lens, each base including means for releasably attaching each base to any one of another of said plurality of bases in order to provide a reusable lens case for a pair of contact lenses, each base having means for sealably accepting a lid;

a plurality of bottoms sized for fitting to each base; and lid means for removably sealing each base cavity.

5. The combined shipping container and reusable lens case system according to claim 4 wherein said bottomless bases and bottoms are formed from a material enabling the heat sealing of said bottoms to said bottomless bases.

6. A packaging method suitable for contact lens shipping and subsequent consumer use, the method comprising the steps of:

disposing a saline solution in a bottomless base having a removable lid thereon;

disposing a contact lens into the saline solution; and permanently sealing a bottom onto the bottomless base by heat sealing.

7. The packaging method according to claim 6 further comprising the step of attaching one base to another to form a consumer lens case for a pair of contact lenses.

8. The packaging method according to claim 6 further comprising the step of selecting a bottom having indicia thereon indicating the configuration of the lens disposed in the saline solution and sealing the selected bottom to the bottomless base.

9. A packaging method suitable for contact lens shipping and subsequent consumer use, the method comprising the steps of:

forming a bottomless base having a lid sealably and removably attached thereto in a manner so that tamper indication is provided upon first removal of the lid;

disposing a saline solution in the bottomless base;

disposing a contact lens into the saline solution;

selecting a bottom having indicia thereon indicating the configuration of the lens disposed in the saline solution;

heat sealing the bottom to the bottomless base; and attaching two bases together to form a consumer lens case for a pair of contact lenses.

10. The packaging method according to claim 9 further comprising the step of orienting the bottom so that after heat sealing thereof to the base, the indicia face the saline solution and contact lens therein.

11. A combined shipping container and reusable lens case system for hydrophilic contact lenses comprising:

a plurality of bottomless bases each having means defining a cavity therein for containing a contact lens, each base having means for sealably accepting a lid;

means, attached to each base, for enabling each base to be manually coupled and separated from any one of another of the plurality of bases to provide a reusable lens case for a pair of contact lens;

a plurality of bottoms sized for fitting to each base; and lid means for removably sealing each base cavity.

* * * * *